US008476513B2

(12) United States Patent
Ponzol et al.

(10) Patent No.: US 8,476,513 B2
(45) Date of Patent: Jul. 2, 2013

(54) KEY CUP ADJUSTMENT DEVICE FOR A WIND INSTRUMENT

(75) Inventors: Peter Ponzol, San Antonio, TX (US); Kerry Klingborg, San Antonio, TX (US); I-Ping Chang, Taichung (TW)

(73) Assignee: Reliance International Corp., Taipei (TW)

( * ) Notice: Subject to any disclaimer, the term of this patent is extended or adjusted under 35 U.S.C. 154(b) by 220 days.

(21) Appl. No.: 13/036,549

(22) Filed: Feb. 28, 2011

(65) Prior Publication Data

US 2012/0167744 A1 Jul. 5, 2012

(30) Foreign Application Priority Data

Dec. 31, 2010 (TW) ..... 99147181 A

(51) Int. Cl.
*G10D 9/04* (2006.01)

(52) U.S. Cl.
USPC ..... 84/385 P

(58) Field of Classification Search
USPC ..... 84/385 P
See application file for complete search history.

(56) References Cited

U.S. PATENT DOCUMENTS

| | | | | |
|---|---|---|---|---|
| 2,033,772 | A | 3/1936 | Loomis | |
| 3,136,200 | A | 6/1964 | Leblanc | |
| 3,688,633 | A | 9/1972 | Nagao | |
| 6,284,958 | B1 | 9/2001 | Aoki et al. | |
| 6,559,366 | B1 * | 5/2003 | Takahashi | 84/380 R |
| 6,642,443 | B2 | 11/2003 | Okada et al. | |
| 6,794,564 | B2 | 9/2004 | Louis | |
| 6,972,361 | B2 | 12/2005 | Shibamiya et al. | |
| 2005/0116467 | A1 | 6/2005 | Ogawa | |

FOREIGN PATENT DOCUMENTS

| | | |
|---|---|---|
| TW | I283855 B | 7/2007 |
| TW | I288395 B | 10/2007 |
| TW | I300918 | 9/2008 |
| TW | M349534 | 1/2009 |
| TW | M360425 U1 | 7/2009 |

* cited by examiner

*Primary Examiner* — Jianchun Qin
(74) *Attorney, Agent, or Firm* — C. G. Mersereau; Nikolai & Mersereau, P.A.

(57) ABSTRACT

A key cup adjustment device for a wind instrument has a hinge rod and a key cup assembly. The key cup assembly is mounted on the hinge rod and has at least one solid arm, a key cup, at least one adjusting arm and at least one abutting unit. The at least one solid arm is mounted securely between the hinge rod and the key cup. The at least one adjusting arm is mounted securely on the at least one solid arm and corresponds to the key cup. The at least one abutting unit is connected to the at least one adjusting arm and can be adjusted to abut the key cup. Therefore, the key cup can close a corresponding tone hole tightly and pitches produced by wind instruments are accurate.

5 Claims, 5 Drawing Sheets

KEY CUP ADJUSTMENT DEVICE FOR A WIND INSTRUMENT

BACKGROUND OF THE INVENTION

1. Field of the Invention

The present invention relates to a wind instrument, and more particularly to a key cup adjustment device for a wind instrument that provides a better closing effect to a tone hole.

2. Description of the Prior Arts

A wind instrument is a musical instrument that contains a tubular resonator. According to methods of producing sound, wind instruments are grouped into two families: brass instruments and woodwind instruments. For the woodwind instruments, the player blows air into the tubular resonator to make air within the tubular resonator vibrate and sound. The woodwind instruments include clarinets, oboes, flutes and saxophones and the like.

With reference to FIG. 6, a conventional saxophone has a tubular resonator 40 flared at a tip to form a bell and having multiple tone holes of various sizes and multiple key devices 41. Each key devices 41 has a hinge rod 411, at least one key cup assembly and a button 414. The hinge rod 411 is rotatably mounted on the tubular resonator 40. The at least one key cup assembly has a solid arm 412 and a key cup 413. The solid arm 412 has two ends. One end of the solid arm 412 is mounted securely on the hinge rod 411. The key cup 413 is mounted securely on the other end of the solid arm 412 and corresponds to one of the tone holes. The button 414 is connected to the hinge rod 411. The button 414 can be pressed to drive the hinge rod 411 to rotate and the key cup 413 to cover and close the corresponding tone hole. Thus, the saxophone can sound different pitches with some of the tone holes standing closed and others opened.

Accuracy of the pitches depends on whether the key cup 413 closes the tone hole tightly or not. However, when the key cup 413 has been actuated repeatedly, tightness between the key cup 413 and tone hole will reduce and air leakage will occur. Therefore, the pitch sounded by the saxophone is inaccurate.

To overcome the shortcomings, the present invention provides a key cup adjustment device for a wind instrument to mitigate or obviate the aforementioned problems.

SUMMARY OF THE INVENTION

The main object of the present invention is to provide a key cup adjustment device for a wind instrument that can close the tone hole tightly.

To achieve the foregoing objective, the key cup adjustment device for a wind instrument in accordance with the present invention comprises a hinge rod and a key cup assembly. The key cup assembly is mounted on the hinge rod and has at least one solid arm, a key cup, at least one adjusting arm and at least one abutting unit. Each one of the at least one solid arm has two ends. One end of the at least one solid arm is mounted securely on the hinge rod. The other end of the at least one solid arm is mounted securely on an outer surface of the key cup. Each one of the at least one adjusting arm has a connecting end and a free end. The connecting end is mounted securely on the at least one solid arm. The free end corresponds to the outer surface of the key cup. The at least one abutting unit is connected to the free end of the at least one adjusting arm. The at least one abutting unit can be adjusted to abut the key cup so the key cup can close a corresponding tone hole tightly and pitches produced by wind instruments are accurate.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
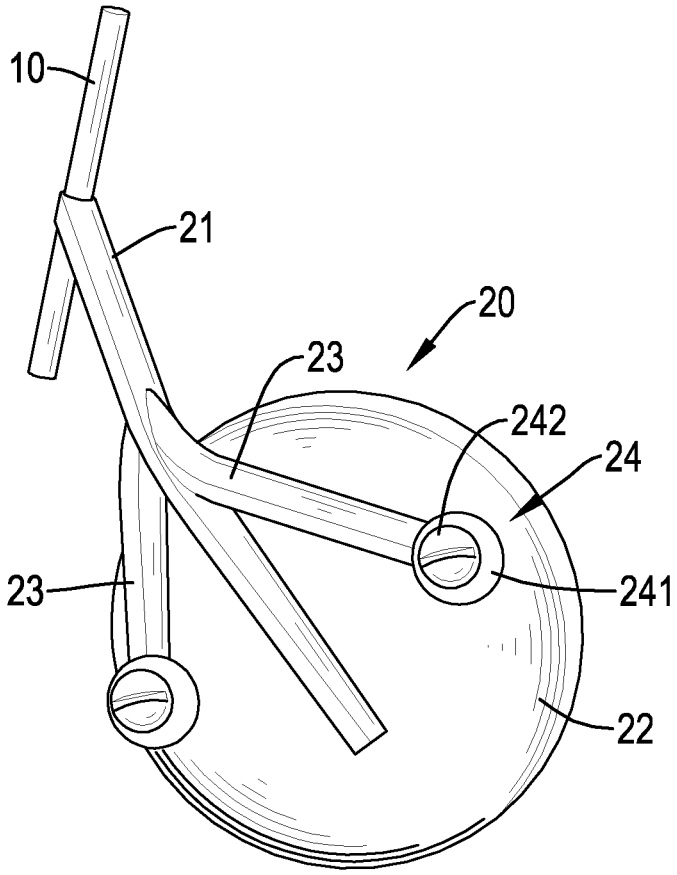
FIG. 1 is a perspective view of a key cup adjustment device for a wind instrument in accordance with the present invention.

With reference to FIG. 1, a key cup adjustment device for a wind instrument in accordance with the present invention comprises a hinge rod 10 and a key cup assembly 20.

The key cup assembly 20 is mounted on the hinge rod 10 and has at least one solid arm 21, a key cup 22, at least one adjusting arm 23 and at least one abutting unit 24. Each one of the at least one solid arm 21 has two ends. One end of the solid arm 21 is mounted securely on the hinge rod 10. The other end of the solid arm 21 is mounted securely on an outer surface of the key cup 22.

Figure 5:
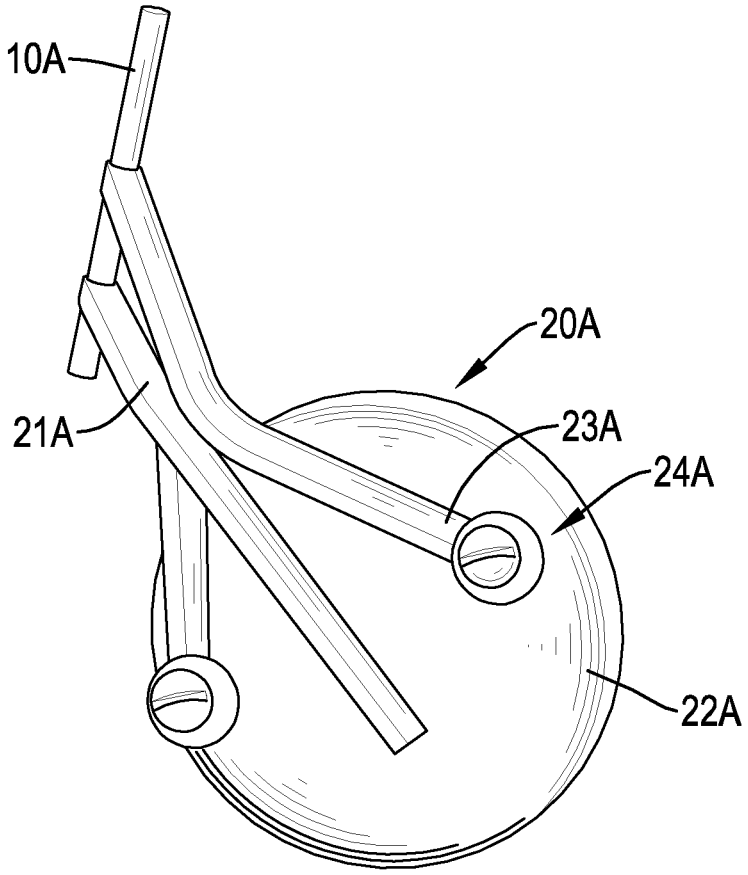
FIG. 5 is a perspective view of another embodiment of a key cup adjustment device for a wind instrument in accordance with the present invention.
Figure 6:
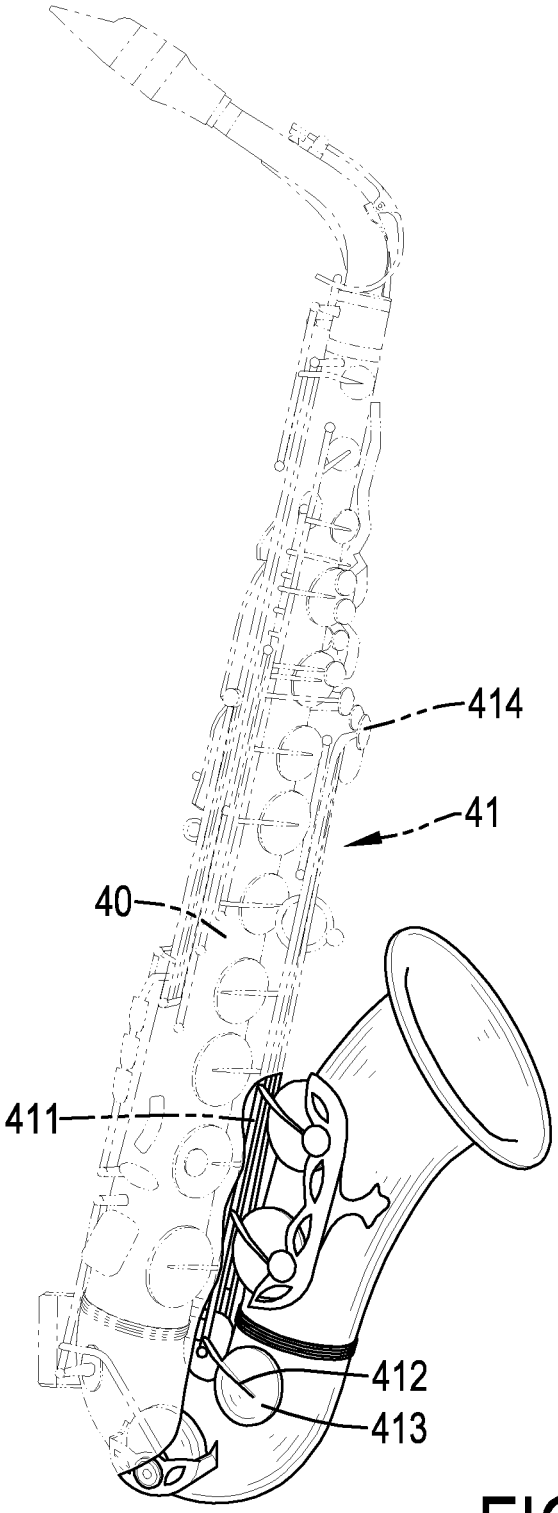
FIG.6 PRIOR ART
FIG. 6 is a perspective view of a conventional saxophone in accordance with the prior art.

The at least one adjusting arm 23 is mounted on the at least one solid arm 21 and each one of the at least one adjusting arm 23 has a connecting end and a free end. The connecting end is mounted securely on a corresponding solid arm 21. The free end corresponds to the outer surface of the key cup 22. With reference to FIG. 5, in another embodiment, one of the at least one adjusting arm 23A further has a middle section being bended and mounted securely on one of the at least one solid arm 21A. The connecting end of the at least one adjusting arm 23A is mounted securely on the hinge rod 10A. Both the solid rod 21A and the adjusting arm 23A mounted securely on the hinge rod 10A enhance structural strength between the key cup assembly 20A and the hinge rod 10A.

Figure 3:
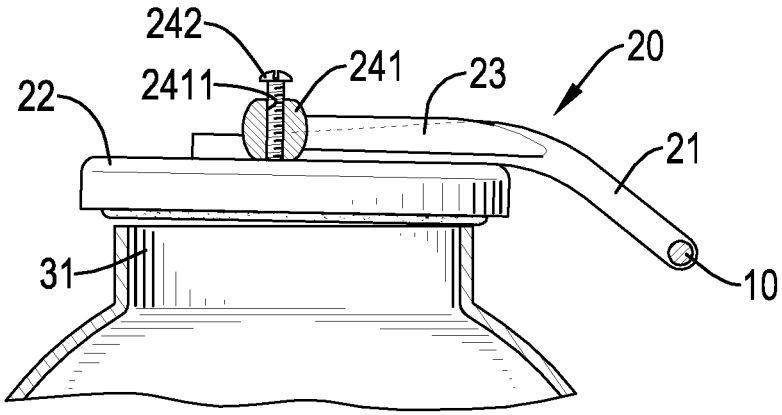
FIG. 3 is a side view in partial section of the key cup adjustment device for a wind instrument in FIG. 1.

Each one of the at least one abutting unit 24 is connected to the free end of one of the at least one adjusting arm 23 and has a positioning boss 241 and a screw 242. With further reference to FIG. 3, the positioning boss 241 has a threaded hole 2411. The screw 242 is screwed into the threaded hole 2411 of the positioning boss 241 and has an end surface abutting the outer surface of the key cup 22.

In a preferred embodiment, the key cup assembly 20 has one solid arm 21, two adjusting arms 23 and two abutting units 24. The adjusting arms 23 are connected to a middle section and respectively at two sides of the solid arm 21. The abutting units 24 are connected respectively to the free ends of the adjusting arms 23 and are symmetrical relative to the solid arm 21.

Figure 2:
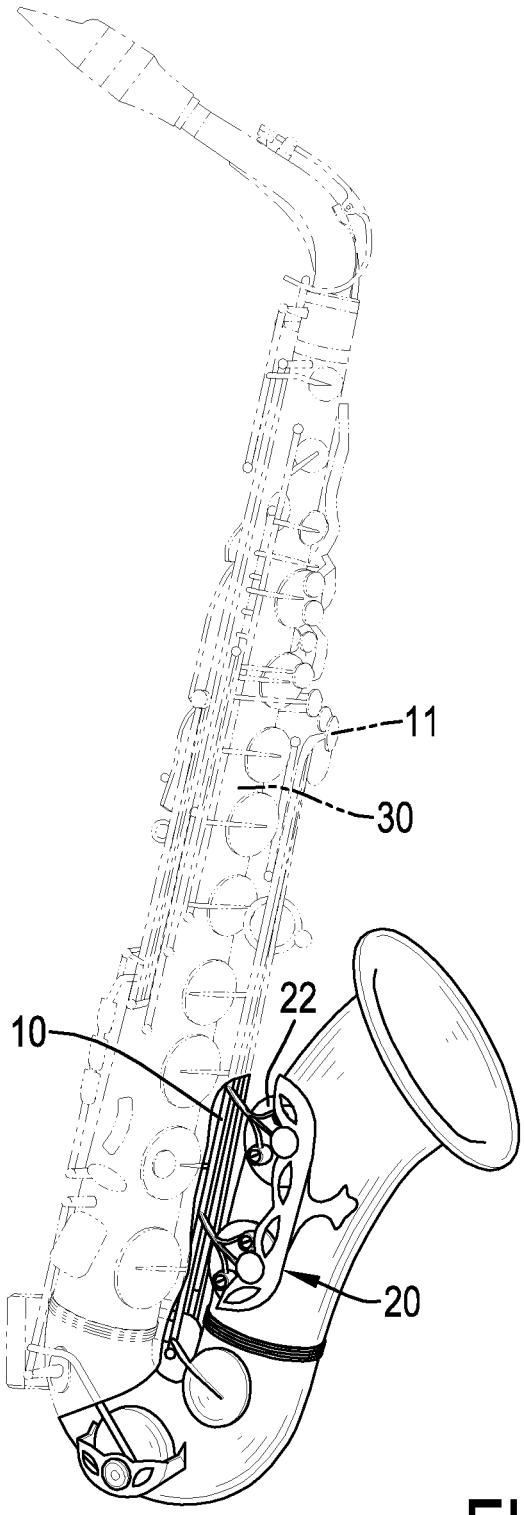
FIG. 2 is a perspective view of a saxophone with the key cup adjustment device in FIG. 1.

With reference to FIGS. 2 and 3, the key cup adjustment device in accordance with the present invention is mounted on a tubular resonator 30 of a saxophone to make the hinge rod 10 rotatable relative to the tubular resonator 30 and the key cup 22 correspond to one of the tone holes 31 of the tubular resonator 30 and a button 11 is connected to the hinge rod 10. The button 11 can be pressed to drive the hinge rod 10 to rotate and the key cup 22 to cover and close the corresponding tone hole. Thus, the saxophone can sound with different pitches with some of the tone holes standing closed and others opened.

Figure 4:
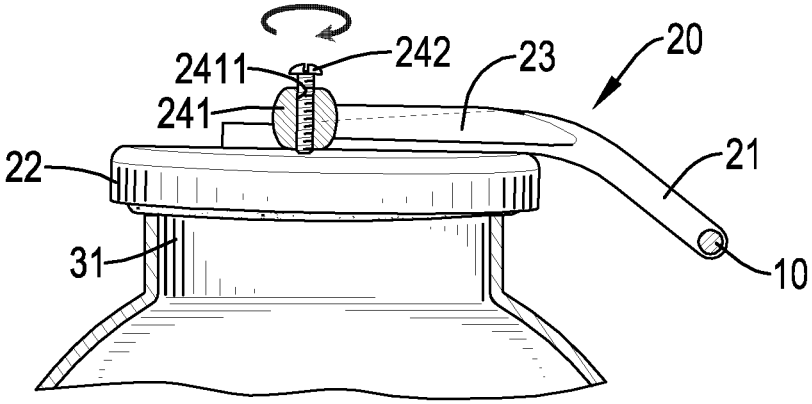
FIG. 4 is an operational side view in partial section of the key cup adjustment device for a wind instrument in FIG. 1, showing an abutting unit being adjusted to abut a key cup.

With reference to FIG. 4, when the key cup 22 has been actuated repeatedly and is unable to close the tone hole tightly, the screw 242 can be screwed further into the threaded hole 2411 of the positioning boss 241 deeply to make the end surface of the screw 242 abut the outer surface of the key cup 22 and the key cup 22 move toward the tone hole 31. Therefore, the key cup 22 is restored to close the tone hole 31 tightly, air leakage is prevented and the saxophone can sound accurate pitches.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A key cup adjustment device for a wind instrument comprising:

a hinge rod; and a key cup assembly mounted on the hinge rod and having:

at least one solid arm, each one of the at least one solid arm having:

two ends, one of the ends mounted securely on the hinge rod and the other end mounted securely on a key cup;

at least one adjusting arm mounted on the at least one solid arm and each one of the at least one adjusting arm having a free end corresponding to an outer surface of the key cup; and at least one abutting unit, and each one of the at least one abutting unit connected to the free end of one of the at least one adjusting arm and having:

a positioning boss having a threaded hole; and a screw screwed into the threaded hole of the positioning boss and having an end surface abutting the outer surface of the key cup.

2. The key cup adjustment device for a wind instrument as claimed in claim 1, wherein each one of the at least one adjusting arm further has a connecting end mounted securely on one of the at least one solid arm.

3. The key cup adjustment device for a wind instrument as claimed in claim 2, wherein the key cup assembly has one solid arm;

two adjusting arms connected respectively to two sides of the solid arm; and two abutting units connected respectively to the free ends of the adjusting arms and being symmetrical relative to the solid arm.

4. The key cup adjustment device for a wind instrument as claimed in claim 1, wherein one of the at least one adjusting arm further has a middle section being bended and mounted securely on one of the at least one solid arm; and a connecting end mounted securely on the hinge rod.

5. The key cup adjustment device for a wind instrument as claimed in claim 4, wherein the key cup assembly has one solid arm;

two adjusting arms connected respectively to two sides of the solid arm; and two abutting units connected respectively to the free ends of the adjusting arms and being symmetrical relative to the solid arm.

* * * * *